United States Patent [19]

Bogaerts

[11] Patent Number: 4,615,152

[45] Date of Patent: Oct. 7, 1986

[54] CYLINDER HONE

[75] Inventor: Leo C. Bogaerts, Antioch, Ill.

[73] Assignee: Ammco Tools, Inc., North Chicago, Ill.

[21] Appl. No.: 796,197

[22] Filed: Nov. 8, 1985

[51] Int. Cl.[4] ..... B24B 9/02

[52] U.S. Cl. ..... 51/332; 51/351; 51/353

[58] Field of Search ..... 51/332, 352, 353, 331, 51/330, 350, 351, 354, 338, 341

[56] References Cited

U.S. PATENT DOCUMENTS

| | | | |
|---|---|---|---|
| 3,005,294 | 10/1961 | Kushmuk . | |
| 3,065,579 | 11/1962 | Clark | 51/331 |
| 3,334,453 | 8/1967 | Von Tersch | 51/353 |
| 3,381,419 | 5/1968 | Johnson | 51/332 |

*Primary Examiner*—Frederick R. Schmidt

*Assistant Examiner*—Maurina Rachuba

*Attorney, Agent, or Firm*—Edmond T. Patnaude

[57] ABSTRACT

A rotary cylinder hone includes an elongate drive shank connected to a carrier arm holder which supports a plurality of arm assemblies having abrasive units carried at the ends thereof. Each arm assembly has a pair of flanges formed at the end opposite the abrasive unit and a projection of the carrier arm holder is receivable therebetween. The flanges have apertures formed therein for receiving a circular retaining ring. The retaining ring is received by a generally circular slot provided in the carrier arm holder projections and serves to support the arm assemblies to the carrier arm holder for pivotable movement in a plane extending generally radially of the drive shank center line, thereby eliminating the need for individual attachment means for each of the arm assemblies.

5 Claims, 3 Drawing Figures

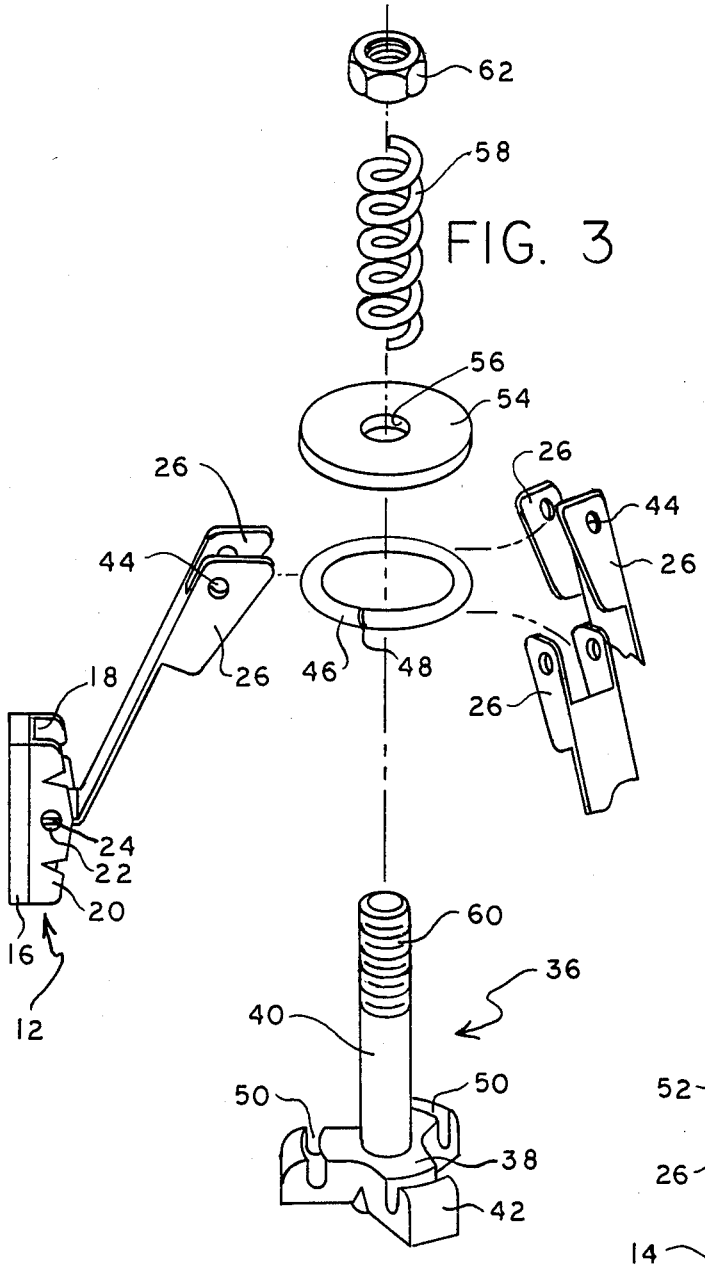
FIG. 3
FIG. 2
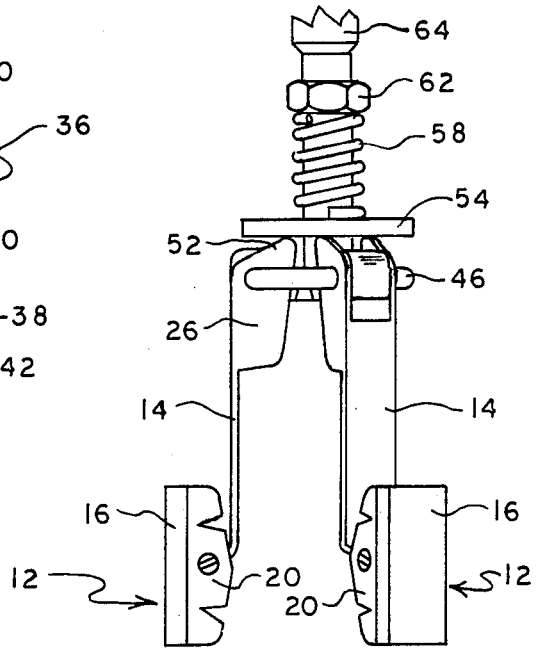

CYLINDER HONE

BACKGROUND OF THE INVENTION

1. Field of the Invention

The present invention relates in general to rotary hones of a type suitable for polishing the walls of cylinders in mechanical apparatus, and it relates in particular to a rotary hone having the capability of being conveniently assembled during manufacture.

2. Description of the Prior Art

In mechanical apparatus incorporating a piston and cylinder arrangement, it is frequently necessary or desirable to resurface the wall of the cylinder such that the piston assembly can form a proper seal with the cylinder wall as it reciprocates therewithin. One such apparatus utilizing a piston and cylinder arrangement, for example, is a disc brake caliper. The piston, which is mechanically connected to a vehicle braking mechanism, is movable within the caliper under the action of fluid pressure. With continued use, the cylinder wall of the caliper can become pitted or scored due to the effects of heat and corrosive action of the fluid contained therein. In servicing the brake system of a vehicle having a worn caliper, it is often possible to remove the surface irregularities in the cylinder walls of the caliper through the use of a simple rotary hone. The caliper assembly can thereby be fitted with new piston seals such that it functions as originally manufactured.

A cylinder hone which has proved particularly effective in resurfacing of disc brake calipers is disclosed, for example, in U.S. Pat. No. 3,005,294, issued to Kushmuk on Oct. 24, 1961, and assigned to the assignee of the present invention. Typically, such a hone comprises a plurality of abrasive units each carried by a pivotal arm extending from a central body member which, in turn, is connected to an elongate drive shaft. The drive shaft is dimensioned to be inserted into the chuck of a standard rotary drill such that the hone may be rotated wthin the cylinder at sufficient speeds to resurface the cylinder wall within a short period of time.

Although cylinder hones of the foregoing general description are well known, it would be desirable to simplify their construction so that they can be more economically manufactured, thereby reducing their cost. One of the manufacturing steps which adds considerably to the cost of manufacturing a cylinder hone is in connecting the abrasive unit arms to a central support member from which the drive shaft extends. Since the arm must be biased outwardly in a pivotal arrangement from the central support member, typical hone structures include individual pin members for connecting the arms to the body member. Installing such pins during assembly of the hone is a manual operation involving considerable manufacturing time thereby adding substantially to the cost of the completed assembly.

SUMMARY OF THE INVENTION

Accordingly, it is an object of the present invention to provide an improved rotary hone having a simplified construction lending economy in its manufacture. In accomplishing this and other objectives of the present invention, there is provided a cylinder hone comprising an elongate drive shank connected to a stem extending from a central carrier arm holder. The carrier arm holder is provided with a plurality of radially extending projections corresponding in number to the number of abrasive unit arms of the cylinder hone assembly. The end of each arm opposite the abrasive unit has a pair of flanges dimensioned to receive a respective projection of the carrier arm holder. Each flange has an aperture formed therein for receiving a generally circular retaining ring thereby providing for the interconnecting of the arms and providing for pivotal movement thereof. Generally circular slots formed in the upper surface of each carrier arm holder projection receive and support the retaining ring such that the arms may freely pivot about the arm holder projections and retaining ring. The circular retaining ring serves to eliminate the need for individual pin members to support the arms for pivotal movement.

DESCRIPTION OF THE DRAWING

The above and other objects and advantages and novel features of the present invention will become apparent from the following detailed description of the preferred embodiment of the invention illustrated in the accompanying drawing wherein:

FIG. 2 is another elevational view illustrating the cylinder hone with the arms in a retracted position;

FIG. 3 is a partial, exploded perspective view of the cylinder hone of FIGS. 1 and 2.

DETAILED DESCRIPTION OF THE PREFERRED EMBODIMENT

Figure 1:
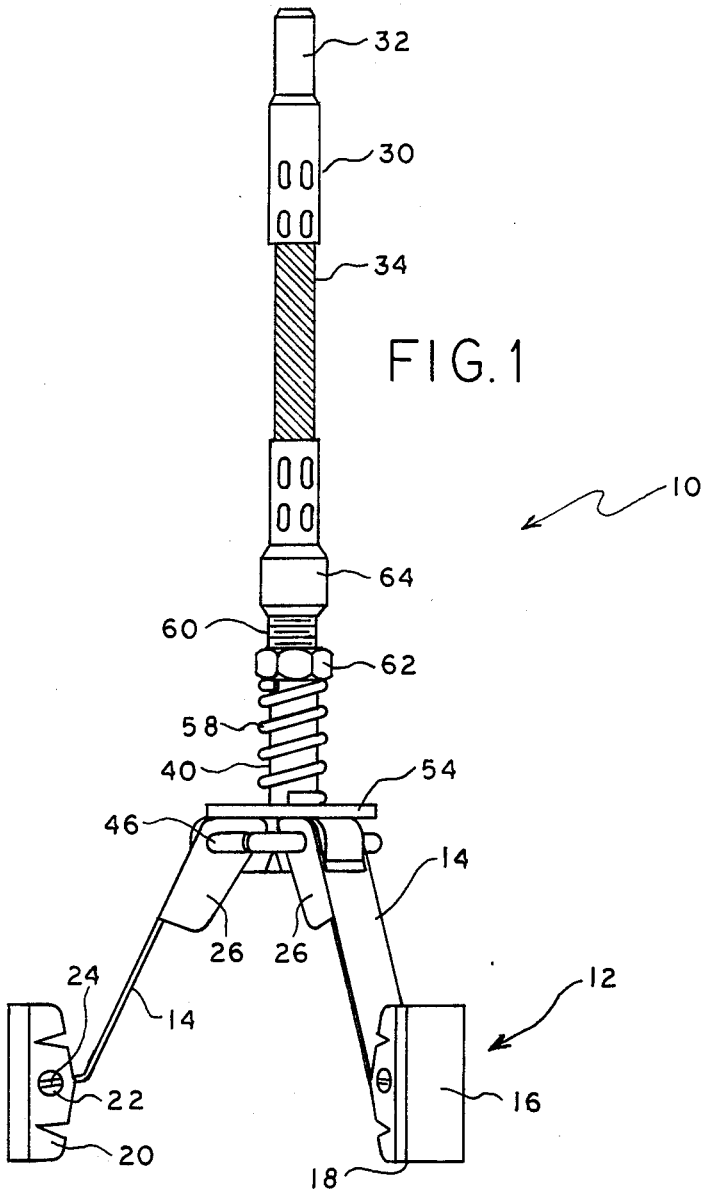
FIG. 1 is an elevational view of a cylinder hone constructed in accordance with the principles of the present invention.

Referring now to the drawing, and initially to FIG. 1, there is illustrated a cylinder hone designated generally by the reference numeral 10. The hone 10 includes a plurality of abrasive units 12 supported at the free ends of carrier arms 14. Each abrasive unit 12 includes a grinding stone 16 attached by suitable bonding means to a carrier 18. In order to support the abrasive units 12 for pivotable movement, thereby allowing each abrasive unit 12 to be self-positioning within the cylinder, the carriers 18 are each formed with a pair of flanges 20 having apertures 22 formed therein. Laterally extending ears 24 formed at the distal ends of the arms 14 cooperate with the apertures 22 of the carrier flanges 20 to permit the abrasive units 12 to freely pivot with respect to the arms 14. At their upper ends, each arm 14 is provided with a pair of parallel spaced flanges 26, the function of which will be described in detail hereinafter. To provide for rotation of the hone 10 a generally elongate drive shank 30 has a distal end 32 adapted to be received within a drill chuck and has a central portion 34 constructed of flexible shafting in a manner well known in the art.

Turning now to FIG. 3, the supporting structure for the arms 14 and abrasive units 12 can be seen to include a central carrier arm holder designated generally by the reference numeral 36. The carrier arm holder 36 comprises a body portion 38 from which an upwardly extending stem 40 extends. Extending radially outwardly from body portion 38 are projections 42 corresponding in number to the number of arms 14 of the hone 10. In accordance with the invention, each flange 26 of the arms 14 is provided with an aperture 44 which receives a split retaining ring 46. The arms 14 are conveniently fitted to the ring by insertion of the flanges 26 through an opening 48 of the retaining ring 46. With the arms 14 installed on the retaining ring 46 the arms 14 may be assembled to the arm holder member 36 such that each projection 42 of the body member 38 fits between the flanges 26, 26 of a respective arm 14. To position the retaining ring 46 immovable with respect to the body member 38, each projection 42 is provided with a generally circular slot 50 which receives the retaining ring 46 when the hone 10 is fully assembled.

With reference now to FIG. 2 it can be seen that the arms 14 are normally biased to an extended configuration due to the provision of curvilinear edges defining cam surfaces 52 on the upper ends of the flanges 26 of each arm 14. A circular collar 54 having a central aperture 56 for receiving the stem 40 of the carrier arm holder 36 is biased against the cam surfaces 52 of the arm flanges 26 by a suitable spring 58 mounted concentrically about the stem 40 of the carrier arm holder 36. To adjust the tension on the spring 58, the stem 40 is formed with a threaded distal end portion 60 upon which a hex nut 62 is threaded. The threaded portion 60 of the stem 40 also provides for connection of the carrier arm holder 36 to the end 64 of the drive shank 30.

It can be appreciated that when the hone is being assembled, the arms 14 may be readily assembled to the retaining ring 48, as previously described, and then the ring 46 and arms 14 can simply be mounted to the carrier arm holder 36 by suitable positioning of the flanges 26 for proper alignment with the projections 42 of the carrier arm holder body member 38. The foregoing structure therefore permits the hone 10 to be readily assembled in manufacture without the need for separate fastening means, such as individual pin members for each of the arms 14. Moreover, cooperation between the retaining ring 46 and the projection 42 of the carrier arm holder 36 permits the arms 14 to be firmly supported for pivotal movement in a respective plane extending generally radially outwardly from the center line of the hone 10, thereby preventing chatter as the hone 10 is in use.

While the present invention has been described in connection with particular embodiments thereof, it will be understood by those skilled in the art that many changes may be made without departing from the true spirit and scope of the present invention. Therefore, it is intended by the appended claims to cover all such changes and modifications which come within the true spirit and scope of this invention.

I claim:

1. A cylinder hone comprising in combination an elongate drive shank;

a plurality of arms, each arm having a first free end;

an abrasive unit carried on said first free end of each arm;

a second end of each arm terminating with a pair of flanges, said flanges being generally parallel one to another and each being formed with a curvilinear edge defining a cam surface projecting away from said second end;

a carrier arm holder disposed centrally of said arms and having a central stem extending therefrom connected to said drive shank, said carrier arm holder having a plurality of projections extending radially outwardly from said stem;

said projections each being received within a pair of flanges provided on a respective arm assembly;

a collar member having a central aperture through which said stem extends and biased into abutment with said cam surfaces of said flanges;

an aperture formed in each of said flanges;

a generally circular retaining ring received within the apertures of said flanges;

whereby said arms are supported by said retaining ring for pivotable movement in a plane extending generally radially of the centerline of said drive shank.

2. The cylinder hone of claim 1 wherein each projection of said carrier arm holder is received within the pair of flanges of a respective arm.

3. The cylinder hone of claim 1 wherein each projection is formed with a generally circular slot for receiving said retaining ring.

4. The cylinder hone of claim 3 wherein said retaining ring is captured within said slots by the biasing engagement of said collar member and said cam surfaces of said flanges.

5. The cylinder hone of claim 1 wherein said retaining ring is formed with a split opening and said flanges are receivable through said opening in assembly of said arms to said retaining ring.

* * * * *